US010335967B2

(12) United States Patent
Neyer et al.

(10) Patent No.: US 10,335,967 B2
(45) Date of Patent: Jul. 2, 2019

(54) SHAVER WITH LIGHT SOURCE

(71) Applicant: Braun GmbH, Kronberg (DE)

(72) Inventors: Christian Neyer, Eschborn (DE); Martin Fuellgrabe, Bad Camberg (DE); Lucy Zimmermann, Kronberg (DE); Stefan Siebert, Hanau (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 15/879,524

(22) Filed: Jan. 25, 2018

(65) Prior Publication Data

US 2018/0207823 A1 Jul. 26, 2018

(30) Foreign Application Priority Data

Jan. 26, 2017 (EP) ..... 17153262

(51) Int. Cl.

| | |
|---|---|
| ***B26B 19/46*** | (2006.01) |
| ***A45D 27/00*** | (2006.01) |
| ***B26B 19/10*** | (2006.01) |
| *A45D 26/00* | (2006.01) |

(52) U.S. Cl.

CPC ..... *B26B 19/46* (2013.01); *A45D 27/00* (2013.01); *B26B 19/102* (2013.01); *A45D 26/0033* (2013.01); *A45D 2026/008* (2013.01)

(58) Field of Classification Search

CPC ..... B26B 19/46; B26B 19/102

USPC ..... 362/115

See application file for complete search history.

(56) References Cited

U.S. PATENT DOCUMENTS

| | | | | |
|---|---|---|---|---|
| 3,027,507 | A | 3/1962 | Hubner | |
| 4,274,199 | A | 6/1981 | Gallanis et al. | |
| 4,835,861 | A | 6/1989 | Mahlich | |
| 5,423,125 | A | 6/1995 | Wetzel | |
| 2008/0010834 | A1* | 1/2008 | Oglesby | B26B 21/46 30/34.05 |
| 2009/0049694 | A1 | 2/2009 | Morris | |

FOREIGN PATENT DOCUMENTS

| | | |
|---|---|---|
| DE | 89 02 679 | 4/1989 |
| EP | 2 789 433 | 10/2014 |

OTHER PUBLICATIONS

European search report dated Aug. 14, 2017.

* cited by examiner

*Primary Examiner* — Sean P Gramling
(74) *Attorney, Agent, or Firm* — Ronald T. Sia; Kevin C. Johnson

(57) ABSTRACT

The present invention is concerned with an electrically operable shaver with an elongate shaver housing defining a longitudinal axis (I), at least one short-hair cutter unit, at least one long-hair trimmer unit disposed on the shaver housing and at least one light source. The at least one light source is movable substantially parallel to the longitudinal axis (I) between a retracted position and an extended position.

15 Claims, 1 Drawing Sheet

SHAVER WITH LIGHT SOURCE

FIELD OF THE INVENTION

The present invention is concerned with an electronically operated hair removing device, such as a shaver, a hair or beard clipper, an epilation device or the like, having an electrically operated equipment, e.g. a light source. In more detail, the present invention refers to an electrically operable shaver with a shaver housing defining a longitudinal axis, at least one short-hair cutter unit, at least one long-hair trimmer unit disposed on the housing and at least one light source.

BACKGROUND OF THE INVENTION

A shaver with a single short-hair cutter unit and a light source arranged on the lateral side of the shaver housing is known from DE 2 117 663 A1. In addition, EP 1 657 485 B1 discloses an epilator with an LED which is a component of an axially movable switch. A further epilator is disclosed in WO 2014/206852 A1. This epilator comprises a light source which is adjustable regarding its position on the epilator. A hair trimming device with a movable light source is known from EP 2 869 973 B1. Further, a shaver comprising two short-hair cutter units with an internal illumination device and one long-hair trimmer unit is disclosed in EP 1 326 738 B1 and EP 1 326 739 B1. The use of light sources in the above-mentioned devices is either known for indicating a certain operation mode of the device, e.g. indicating that the device is turned on, indication of a specific motor or shaving mode, or for illumination of the user's skin, thereby facilitating hair removal.

A shaver comprising at least one short-hair cutter unit and at least one long-hair trimmer unit may be operated in different modes, namely predominantly using the at least one short-hair cutter unit or predominantly using the at least one long-hair trimmer unit. This may require different illumination modes adapted to the individual operation modes. It is an object of the present disclosure to provide an improved shaver or the like hair removing device.

SUMMARY OF THE INVENTION

This object is solved by a shaver with the features of claim 1. Advantageous further features are set forth with the features of the sub-claims.

In accordance with one aspect of the present disclosure an electrically operable shaver may comprise an elongate shaver housing defining a longitudinal axis, at least one short-hair cutter unit, at least one long-hair trimmer unit disposed on the shaver housing and at least one electrically operated equipment or appliance, like a light source. The shaver comprises a shaver head which is moveable with respect to the shaver handle housing comprising at least one short-hair cutter unit and at least one long-hair trimmer unit and an additional long-hair trimmer unit disposed on the shaver handle housing, which is movable substantially parallel to the longitudinal axis between a retracted idle position and an extended operating position and at least one light source, wherein, the light source is movable substantially parallel to the longitudinal axis between a retracted position and an extended position and the light source is mounted on or integrated in the at least one long-hair trimmer unit and wherein the shaver head is angled relative to the longitudinal axis. The longitudinal axis of the shaver housing typically runs from a distal end, i.e. the end facing towards the user's skin during use of the shaver, to an opposite proximal end, wherein the distal end may be provided with a shaver head and/or the long-hair trimmer unit. The at least one electrically operated equipment, e.g. the light source, may be movable substantially parallel to the longitudinal axis between a retracted position and an extended position. As an alternative to a light source the electrically operated equipment may be a heat source or heat sink or a source of radiation. The change in the position of the electrically operated equipment with respect to the user's skin may change the intensity of the equipment. For example, a light pattern and/or the illuminated area may change depending on the axial position of a light source. Further, heat transfer to the user's skin may change depending on the distance between the heat source or heat sink to the user's skin. It revealed specifically advantageous if the shaver head is cranked or angled relative to the shaver handle housing (this fixed angled position is provided in addition to an angular position in another direction of the shaver head which may be achieved by the movability of the head) as this provides better illumination possibilities both if the light source is in the retracted or in the extended position of the long hair trimmer (if the light source is mounted or integrated on that as described above).

Further details and features of the invention may be obtained from the following description of embodiments in conjunction with the drawings.

DETAILED DESCRIPTION OF THE INVENTION

Figure 1:
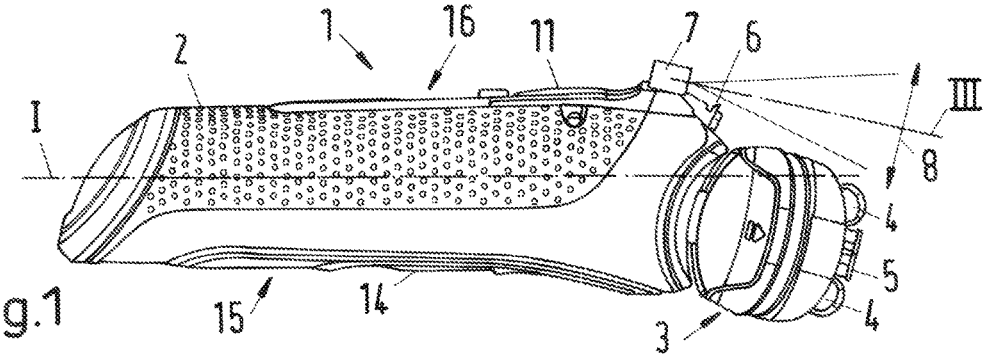
FIG. 1 shows in a schematic side view a shaver according to an embodiment of the invention with a light source in the retracted position.

The at least one long-hair trimmer unit of the shaver may be movable substantially parallel to the longitudinal axis between a retracted idle position and an extended operating position. For example, the shaver may be operated only using the short-hair cutter unit when the long-hair trimmer unit is in its retracted idle position, whereas the shaver may be operated predominantly using the long-hair trimmer unit when the long-hair trimmer unit is in its extended operating position. This change of the position of the long-hair trimmer unit may be used for movement of the light source or the like electrically operated equipment. For example, the long-hair trimmer unit may entrain the electrically operated equipment during its axial movement. According to an example of the present disclosure, the at least one electrically operated equipment may be movable together with the at least one long-hair trimmer unit between the retracted position and the extended position. This includes embodiments in which the electrically operated equipment is mechanically coupled to the long-hair trimmer unit such that the movement of the long-hair trimmer unit causes a movement of the electrically operated equipment. Such a mechanical coupling may include a gearing or the like causing as an alternative the movement of the electrically operated equipment in a different direction and/or with a different speed with respect to the long-hair trimmer unit.

In a more detailed embodiment of the present disclosure of an electrically operable shaver, the at least one electrically operated equipment is mounted on or integrated in the at least one long-hair trimmer unit. This results in a simultaneous movement in the same direction of the electrically operated equipment and the long-hair trimmer unit. For example, the at least one electrically operated equipment may be mounted on the at least one long-hair trimmer unit on a side facing away from the shaver housing.

The light source is mounted on the additional long-hair trimmer unit on a side facing away from the shaver housing and the shaver head is angled towards a first lateral side of the shaver handle housing which is opposite to the second lateral shaver handle housing side at which the light source is mounted the on additional the long hair trimmer unit.

The shaver handle housing comprises a shaver on/off switch arranged on a first lateral housing side and the light source is mounted on the additional long hair trimmer unit on a second lateral housing side which is on the opposite side to the first lateral housing side.

The light source is provided with an optical axis which is substantially perpendicular to a plane, said plane being defined by a distal edge of the at least one short-hair cutter unit and a distal edge of the additional long-hair trimmer unit when in its extended operating position.

Therefore, in the retracted position of the long hair trimmer with integrated light source the angled shaver head creates a free space (on the side which is opposite to the first lateral side to which the shaver head is angled towards) to be illuminated by the light source which is substantially parallel to an extension of the longitudinal axis of the shaver handle housing. This allows a more direct control on the field to be illuminated and avoids inadvertent illumination of e.g. the eye. The light source may be controlled like a rod like flashlight as the optical axis of the light source is substantially perpendicular to the skin level plane P, so that an ideal light spot is created despite the shaver head being cranked relative to the handle. In the extended position of the additional long hair trimmer with light source integrated on or in that the complete long hair trimmer moves into that free space on the back side of the shaver head and a similar benefit is achieved as in the retracted position with respect to the light spot shape on the skin level.

Irrespective of the above embodiments or in addition to that, an electrically operable shaver, for example the shaver as defined above, comprises an elongate shaver housing defining a longitudinal axis, at least one short-hair cutter unit, at least one long-hair trimmer unit, which is disposed on the shaver housing and which is movable substantially parallel to the longitudinal axis between a retracted idle position and an extended operating position, and at least one light source, wherein the at least one light source when in its retracted position has an illuminance in the range of 200 lx to 2.000 lxin an illuminated area of a plane or surface level defined by a distal edge of the at least one short-hair cutter unit and a distal edge of the at least one long-hair trimmer unit when in its extended operating position. The plane or surface level P defined by a distal edge of the at least one short-hair cutter unit and a distal edge of the at least one long-hair trimmer unit when in its extended operating position typically corresponds to the user's skin level during use of the shaver. In other words, in the retracted position, the illuminance on the skin may be in the range of 200 lx to 2000 lx in the central region of the light spot or illuminated area. The illuminated area corresponds to plane P, i.e. skin contact level with the shaver head cutting units are in skin contact.

The at least one light source of the shaver may emit light in a cone shape with limited opening angle. For example, the at least one light source may comprise an optical unit, like a lens or the like, for shaping an illuminated area, preferably into an elongate, oval and/or semi-circle form.

According to a further aspect, the at least one light source may generate at least one light spot having an illuminance decreasing from the center of the light spot towards its boundaries by a factor of less than 2 per mm. In other words, the boundaries of the light spot may be shaped in a way that strong contrasts are avoided. Instead, the intensity of the illumination decreases gently with increasing distance from the middle. The decrease can e.g. be less than a factor 4, preferably less than a factor 2, per mm.

Irrespective of the above embodiments or in addition to those, an electrically operable shaver, for example the shaver as defined above, comprises an elongate shaver housing defining a longitudinal axis, at least one short-hair cutter unit, at least one long-hair trimmer unit, which is disposed on the shaver housing and which is movable substantially parallel to the longitudinal axis between a retracted idle position and an extended operating position, and at least one light source, wherein the shaver further comprises a control unit connected to the at least one light source, with the control unit being designed and adapted such that the at least one light source provides a visual feedback to a user. In other words, the light may also be used to give optical feedback to the user during the shave. This feedback can be used to deliver any desired type of information to the user. The feedback may be done by changing any property of the light, such as the intensity, the color or the duration of any on-off time intervals.

In more detail, the control unit may comprise or may be connected to at least one sensor or detector for detecting a condition or position of a shaver component or a magnitude related to the use of the shaver, wherein the control unit is designed and adapted such that the at least one light source provides a visual feedback to a user indicating the condition or position of the shaver component or a magnitude related to the use of the shaver. Such shave related magnitudes may include e.g. the force, applied onto the skin with the shaver. Further, this may include a simple feedback whether the shaver is turned on or is turned off. Further, this may include a feedback regarding an operation mode of the shaver, indication of a specific motor or shaving mode and/or a feedback regarding the charging condition of a battery.

The at least one short-hair cutter unit of the shaver may be provided with a lower cutter linearly oscillating relative to an upper cutter. For example, a short-hair cutter unit may be designed as described in EP 1 326 739 B1, i.e. with the upper cutter comprising a bent shear foil which is provided with hair capture openings. At least one long-hair trimmer unit may be provided interposed between two short-hair cutter units as suggested in EP 1 326 739 B1. According to an aspect of the present disclosure, the at least one long-hair trimmer unit of the shaver comprises two clipping combs which are linearly oscillating relative to each other. At least one long-hair trimmer unit may be located laterally spaced from the at least one short-hair cutter unit. Especially, a long-hair trimmer unit may be movable independent from the at least one short-hair cutter unit.

Different scenarios are possible for controlling the on/off status of the light source. The light source may always be on during the shave. Alternatively, it can have a default state of "on" or "off" when the shaver is turned on and the user may switch it on or off. Further, when the shaver is turned on, the light source may go into the state it had at the end of the last shave and the user may switch it on or off.

To toggle between on and off mode of the light a separate switch may be located on the long hair trimmer housing. A more comfortable on/off toggling can be achieved by an automatic switch via e.g. a vibration sensor integrated in the electronic compartment of the light. This sensor reacts on the vibrations of the shaver motor. So, the light is turned on and off synchronic to the shaver.

Optionally, the user may adapt the color of the light emitted by the light source according to his preferences. The range from warm white via cold white to blue is an example for a range of colors.

Optionally a main battery is provided in the shaver housing (which also drives the shaver motor) and the light source is supplied by said main battery.

Figure 2:
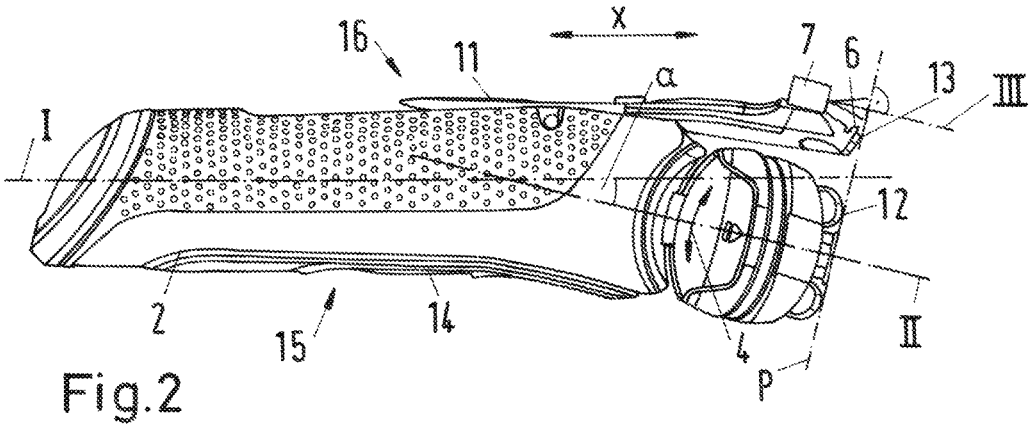
FIG. 2 shows in a schematic side view of the shaver according to FIG. 1 with the light source in the extended position, and FIG. 3 schematically shows an illuminated area on a user's face.

Alternatively, the light source is provided with an individual battery, so a separate battery is provided for the light source which is separate to a main battery for driving the shaver motor. In the embodiment depicted in FIGS. 1 and 2, a shaver 1 comprises a shaver housing 2 with a longitudinal axis I extending from a proximal end (left side in the Figures.) to an opposite distal end facing towards the user's skin during use of the shaver 1. The longitudinal axis I indicates the orientation of the main extension of the elongate shaver housing 2 which forms a grip or handle for holding the shaver 1 during use. FIGS. 1 and 2 depicted in the shaver housing 2 and the shaver head 3 in a slightly bent outer shape, whereas the longitudinal axis I is a straight line.

The shaver 1 comprises a shaver head 3 which may be movable with respect to the shaver housing 2. For example, the shaver head 3 may swivel e.g. in direction y (see FIG. 2) about at least one axis perpendicular to the longitudinal axis I. In the embodiment depicted in FIGS. 1 and 2, the shaver head 3 is provided with two short-hair cutter units 4 and a long-hair trimmer unit 5 interposed between the short-hair cutter units 4. Each short-hair cutter unit 4, comprises an upper cutter in the form of an, e.g. fixed, bent shear foil which is provided with hair capture openings and a lower cutter in the form of a series of blades linearly oscillating with respect to the shear foil. The long-hair trimmer unit 5 comprises two clipping blades or clipping cutters, e.g. in the form of combs, which are linearly oscillating relative to each other. The shaver head 3 is located angled/inclined/cranked along crank axis II with respect to the longitudinal axis I on the shaver housing 2 by an angle a (between crank axis II and longitudinal axis I). As an alternative, the shaver head 3 may have a different orientation, for example extending predominantly parallel to the longitudinal axis I.

An additional long-hair trimmer unit 6 is provided laterally spaced from the shaver head 3 on the upper lateral side (as seen in FIGS. 1 and 2) of the shaver housing 2. The additional long-hair trimmer unit 6 comprises two clipping blades which are linearly oscillating relative to each other. A comparison of FIGS. 1 and 2 shows that the additional long-hair trimmer unit 6 is axially movable with respect to the shaver housing 2 predominantly parallel to the longitudinal axis I. FIG. 1 shows the retracted idle position of the long-hair trimmer unit 6, whereas FIG. 2 shows the extended operation position of the long-hair trimmer unit 6.

As an alternative to the predominantly parallel movement of the long-hair trimmer unit 6 with respect to the longitudinal axis I along directions x, the long-hair trimmer unit 6 may perform a substantially parallel movement with respect to the longitudinal axis I which may include a slightly curved movement and/or a movement including an angle between the longitudinal axis I and the main direction of movement of the long-hair trimmer unit 6. The additional long-hair trimmer unit 6 may be guided on the shaver housing 2, for example by means of an axially shiftable guiding member 11 received in respective tracks (not shown) of the shaver housing 2, and may be releasably fixed in the retracted position (FIG. 1) and/or in the extended position (FIG. 2). A plane P defined by a respective distal edge 12 of the short-hair cutter units 4 and a distal edge 13 of the additional long-hair trimmer unit 6 in its extended operating position is shown in FIG. 2. This plane P corresponds to the user's skin during use of the shaver 1.

The axial movement of the additional long-hair trimmer unit 6 may be used for switching the long-hair trimmer unit 6 on and off. For example, the long-hair trimmer unit 6 may be a decoupled from a driving motor (not shown) of the shaver in its retracted condition and may be coupled to such a driving motor in its extended condition. As an alternative, the long-hair trimmer unit 6 may permanently operate when the shaver 1 is switched on via on/off switch 14. Typically, the shaver head 3 is predominantly used when the additional long-hair trimmer unit 6 is in its retracted position, whereas the additional long-hair trimmer unit 6 is predominantly used when the additional long-hair trimmer unit 6 is in its extended position. The on/off switch 14 for switching the shaver motor on or off is provided on a first lateral side 15 of the shaver handle housing 2. It is the same side towards which the shaver head is angled relative to the shaver handle housing. The additional long hair trimmer 6 is provided on the opposite second lateral side of the shaver handle housing which is opposite to the first lateral side.

A light source 7 is provided on the additional long-hair trimmer unit 6. In the embodiment depicted in FIGS. 1 and 2, the light source 7 is integrated in the additional long-hair trimmer unit 6. As an alternative, the light source 7 may be, e.g. releasably, mounted on the additional long-hair trimmer unit 6. Thus, the light source 7 is entrained by the additional long-hair trimmer unit 6 if it moves axially as described above. As a further alternative, the light source 7 may move independent of the additional long-hair trimmer unit 6, preferably substantially parallel to the longitudinal axis I, between a retracted position and an extended position.

The light source 7 may comprise at least one LED. In addition, the light source 7 may comprise at least one optical unit, like a lens, a light duct or the like, for generating a predefined pattern of light distribution and/or for guiding light. In other words, an LED may be positioned remote from the position indicated as a light source 7 in FIGS. 1 and 2 with a light duct interposed between the LED and the light source 7. Thus, light source 7 may either be an LED or the like or may indicate an exemplary position where light is emitted from the shaver 1.

Figure 3:
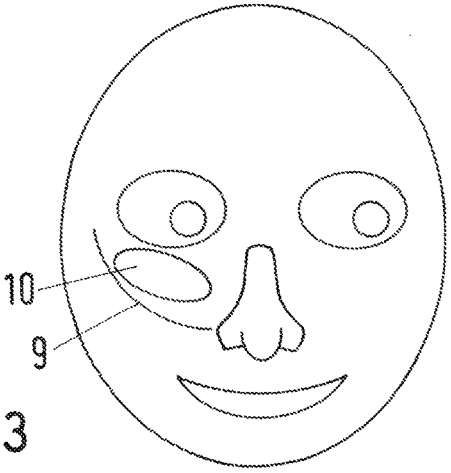

As depicted in the embodiment of FIGS. 1 and 2, the light source 7 emits light in a cone shape with limited opening angle. The light cone is shaped in a way that it extends differently sidewards and vertically (as seen in FIGS. 1 and 2). The vertical extension 8 of the light cone is for example dimensioned as follows: FIG. 3 shows a line 9 under which the beard dominantly grows. This line has typically a distance of several cm to the eye. The light cone is shaped in such a way that the area 10 on the face illuminated by the light source 7 stays under the eye when the user shaves up to this line 9. As a result, the user does not dazzle his eye. This may be achieved e.g. by an optics that focusses differently for different directions. An example for a simple optics with such properties is realized by using a lens in the light source 7 or additional to the light source that is e.g. shaped like a profile with a basically semicircle cross section. Optionally, the optical axis of the light source is perpendicular to the plane P. Thus, the spot of the light source can be well controlled.

As mentioned above, the point where the light leaves the light source 7 of the shaver 1 is mounted on an element that can be shifted with respect to the shaver body along direction x which may be parallel to the longitudinal axis I, to change the distance to the skin. In the embodiment depicted in the FIGS. 1 and 2 an already existing movable or shiftable element of the shaver is used here, namely the additional long-hair trimmer unit 6 of the shaver. However, the present invention is not limited to embodiments having the light source 7 provided on or in the additional long-hair trimmer unit 6. Rather, the light source 7 may be provided on any other suitable element moving substantially parallel to the longitudinal axis I.

Mounting the light source 7 on a shiftable element offers the possibility for another setting. While the situation depicted in FIG. 1 corresponds to a non-used long-hair trimmer unit 6, the light gets new properties when the additional long-hair trimmer unit 6 is used. When the additional long-hair trimmer unit 6 is shifted towards the skin along direction x, the light cone becomes significantly shorter and illuminates a small skin area only. This area is very near to the location where the additional long-hair trimmer unit 6 touches the skin. The small distance of the light source 7 to the skin makes the illumination focused, bright and precise. It exceeds strongly the illuminance values that were given before for the retracted position of the light source 7 by a factor between 10 to 30. This is a well-adapted illumination for precise working such as cutting precise shapes. So, it is well adapted to the purpose of the additional long-hair trimmer unit 6. This is of special advantage for beard styling.

In addition, the change in the light properties on a user's skin corresponds to the change of the operation mode of the shaver 1 by axially moving the additional long-hair trimmer unit 6 from its retracted idle position to its extended operation position. Thus, positioning the light source 7 in or on the additional long-hair trimmer unit 6 results in automatically adapting the light properties or of the pattern of the area illuminated by the light source 7 to the change of the operation mode of the shaver 1.

In the embodiment depicted in FIGS. 1 and 2, the light properties or the pattern of the area illuminated by the light source 7 are mainly influenced by the distance of the light source 7 to the user's skin. However, in addition or as an alternative, the light properties or the pattern of the area illuminated by the light source 7 may be further changed in response to the movement of the additional long-hair trimmer unit 6. For example, the movement of the additional long-hair trimmer unit 6 may cause a change in the intensity and/or color of the light emission of the light source 7 and/or may cause a change in the pattern or form of the area illuminated by the light source 7, e.g. by an adjustment of one or more optical units, like a lens, a shutter, the prism or an aperture.

The light source may be provided with a (not shown) individual energy source, like the battery. As an alternative, a power transfer via induction technology may be provided to supply energy from an external energy source and/or a main battery received in the shaver housing 2 to the light source 7.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electrically operable shaver with an elongate shaver handle housing defining a longitudinal axis, a shaver head moveable with respect to the shaver handle housing comprising at least one short-hair cutter unit and at least one long-hair trimmer unit, an additional long-hair trimmer unit disposed on the shaver handle housing, which is movable substantially parallel to the longitudinal axis between a retracted idle position and an extended operating position and at least one light source, wherein, the light source is movable substantially parallel to the longitudinal axis between a retracted position and an extended position and the light source is mounted on or integrated in the additional long-hair trimmer unit and wherein the shaver head is angled relative to longitudinal axis.

2. The shaver in accordance with claim 1, wherein the light source is mounted on the additional long-hair trimmer unit on a side facing away from the shaver handle housing and the shaver head is angled towards a first lateral side of the shaver handle housing which is opposite to the second lateral shaver handle housing side at which the light source is mounted the on additional the long hair trimmer unit.

3. The shaver in accordance with claim 1, wherein the shaver handle housing comprises a shaver on/off switch arranged on a first lateral housing side and the light source is mounted on the additional long hair trimmer unit on a second lateral housing side which is on the opposite side to the first lateral housing side.

4. The shaver in accordance with claim 2, wherein the light source is provided with an optical axis which is substantially perpendicular to a plane, said plane being defined by a distal edge of the at least one short-hair cutter unit and a distal edge of the additional long-hair trimmer unit when in its extended operating position.

5. The shaver in accordance with claim 4, wherein the at least one short-hair cutter unit is provided with a lower cutter linearly oscillating relative to an upper cutter and the upper cutter comprises a bent shear foil which is provided with hair capture openings or the long-hair trimmer units comprise two clipping blades which are linearly oscillating relative to each other.

6. The shaver in accordance with claim 1, wherein the at least one light source when in its retracted position has an illuminance in the range of about 200 lx to about 2.000 lx in an illuminated area of a plane, said plane being defined by a distal edge of the at least one short-hair cutter unit and a distal edge of the additional long-hair trimmer unit when in its extended operating position.

7. The shaver in accordance with claim 1, wherein the at least one light source emits light in a cone shape with limited opening angle.

8. The shaver in accordance with claim 1, wherein the at least one light source comprises an optical unit for shaping an illuminated area, preferably into an elongate, oval or semi-circle form.

9. The shaver in accordance with claim 1, wherein the at least one light source generates a light spot having an illuminance decreasing from the center of the light spot towards its boundaries by a factor of less than about 2 per mm.

10. The shaver in accordance with claim 1, characterized in that the shaver further comprises a control unit connected to the at least one light source, wherein the control unit is designed and adapted such that the at least one light source provides a visual feedback to a user.

11. The shaver in accordance with claim 10, wherein the control unit comprises or is connected to at least one detector for detecting a condition or position of a shaver component wherein the control unit is designed and adapted such that the at least one light source provides a visual feedback to a user indicating the condition or position of the shaver component or a magnitude related to the use of the shaver.

12. The shaver in accordance with claim 10, wherein the visual feedback comprises a change in the property of the light emitted by the at least one light source, such as intensity, color or duration of any on-off intervals.

13. The shaver in accordance with claim 1, wherein the light source is provided as a LED.

14. The shaver in accordance with claim 13, wherein a main battery is provided in the shaver housing and the light source is supplied by said main battery.

15. The shaver in accordance with claim 1, wherein the light source is provided with an individual battery.

* * * * *